United States Patent [19]

Baird et al.

[11] Patent Number: 4,554,483

[45] Date of Patent: Nov. 19, 1985

[54] ACTIVE CIRCULATOR GYROTRON TRAVELING-WAVE AMPLIFIER

[75] Inventors: J. Mark Baird, Sandy, Utah; Larry R. Barnett, Manassas, Va.; Yue-Ying Lau, Silver Spring, Md.

[73] Assignee: The United States of America as represented by the Secretary of the Navy, Washington, D.C.

[21] Appl. No.: 537,474

[22] Filed: Sep. 29, 1983

[51] Int. Cl.[4] ..... H01J 25/00

[52] U.S. Cl. ..... 315/4; 315/3; 315/5; 328/233; 372/2

[58] Field of Search ..... 315/3, 4, 5; 328/233; 372/2

[56] References Cited

U.S. PATENT DOCUMENTS

| | | | |
|---|---|---|---|
| 3,296,484 | 1/1967 | Feinstein . | |
| 3,887,832 | 6/1975 | Drummond | 328/233 |
| 4,122,372 | 10/1978 | Walsh . | |
| 4,200,820 | 4/1980 | Symons . | |
| 4,224,576 | 9/1980 | Granatstein et al. . | |
| 4,282,458 | 8/1981 | Barnett . | |
| 4,356,430 | 10/1982 | Stone et al. . | |
| 4,362,968 | 12/1982 | Chu et al. . | |
| 4,496,876 | 1/1985 | Young | 315/4 |

OTHER PUBLICATIONS

Y. Y. Lau, L. R. Barnett and V. L. Granatstein, "Gyrotron Travelling Wave Amplifier I.V. Analysis of Launching Losses", Internal Journal of Infrared and Millimeter Waves, vol. 3, No. 1, 1982, pp. 45–62.

Kwo Ray Chu, Y. Y. Lau, Larry R. Barnett, "Theory of a Wide-Band Distributed Gyrotron Traveling-Wave Amplifier", IEEE Transactions on Electron Devices, vol. ED-28, No. 7, Jul. 1981, pp. 866–870.

Larry R. Barnett, "An Experimental Wide-Band Gyrotron Traveling-Wave Amplifier", IEEE Transaction on Electron Devices, vol. ED-28, No. 7, Jul. 1981, pp. 872–874.

*Primary Examiner*—David K. Moore
*Assistant Examiner*—William L. Oen
*Attorney, Agent, or Firm*—Robert F. Beers; William T. Ellis; John L. Forrest

[57] ABSTRACT

An RF cyclotron maser type traveling-wave amplifier including an integral active circulator. The amplifier includes a tapered interaction waveguide having a cross-section which gradually increases from a small first end to a larger second end thereof. The waveguide is capable of supporting first and second orthogonal polarization modes therein with approximately the same propagation characteristics for the two modes. A beam of mildly relativistic electrons having helical electron motion is directed into the small first end to axially propagate within the waveguide toward the larger second end. A tapered magnetic field is generated within the waveguide in a direction approximately parallel to the axis of the waveguide. The magnetic field is profiled to near grazing interaction with the second polarization mode of the waveguide. An input electromagnetic wave in the first polarization mode is launched into the larger second end of the waveguide to propagate toward the first end thereof. The input wave is reflected by the constriction of the tapered waveguide to co-propagate with the electron beam in the waveguide. The reflected input wave additionally excites energy in the second mode which also co-propagates with the electron beam. The first and second modes are amplified by the electron beam; the second polarization mode being amplified to a greater extent than the first mode. The two orthogonal modes are easily separated to provide input and output ports for the amplifier.

21 Claims, 6 Drawing Figures

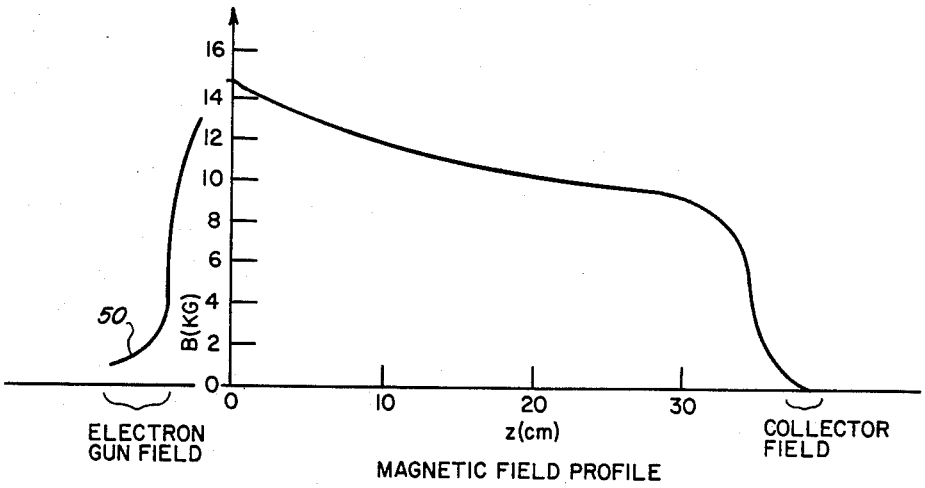
FIG. 4
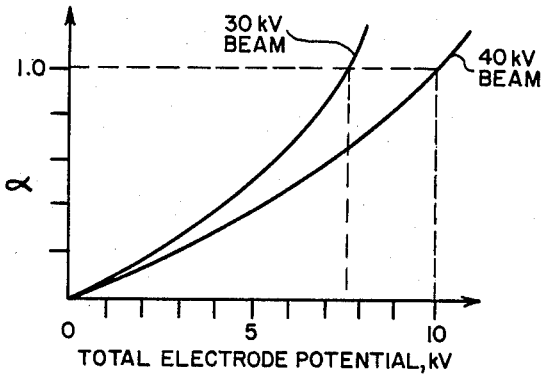
FIG. 5
FIG. 6
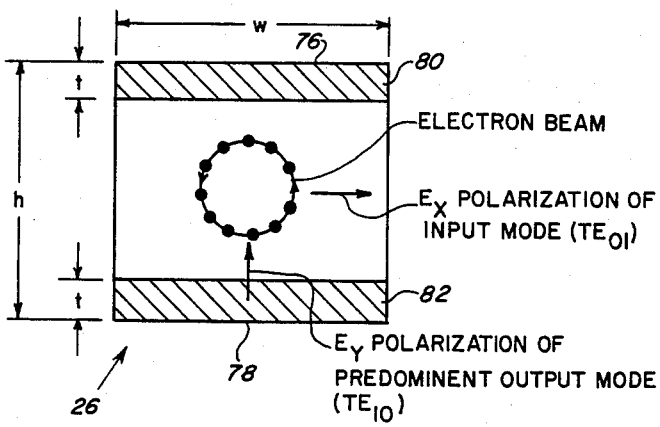

ACTIVE CIRCULATOR GYROTRON TRAVELING-WAVE AMPLIFIER

BACKGROUND OF THE INVENTION

The present Invention relates, in general, to millimeter and submillimeter wave amplifiers and, more particularly, to a novel traveling-wave amplifier which includes an integral active input/output circulator.

Information carrying systems such as radar and communications devices require an amplifier mechanism with substantial instantaneous bandwidth rather than simply an oscillator mechanism. In order to provide wide-band high power operation in traveling-wave amplifiers, the use of a tapered interaction waveguide in conjunction with a specially profiled magnetic field has been proposed in Application Ser. No. 06/389,133, filed June 16, 1982, entitled "Wide-Band Gyrotron Traveling-Wave Amplifier" by Y. Y. LAU, L. R. BARNETT, K. R. CHU, and V. L. GRANATSTEIN. The gyrotron traveling-wave amplifier disclosed therein comprises a tapered waveguide wherein the cross-section thereof gradually increases from a small first end to a larger second end for propagating electromagnetic energy therein, a magnetron injection gun for generating a beam of relativistic electrons with helical electron motion from the small first end of the tapered waveguide to propagate toward the larger second end in the axial direction therein, a magnetic circuit for generating a tapered magnetic field within the waveguide in a direction approximately parallel to the axis of the waveguide, and an input coupler for launching an input electromagnetic wave so that it co-propagates with the electron beam in the waveguide where the input wave is amplified.

The above-mentioned waveguide is tapered such that its cutoff frequency varies over a predetermined bandwidth. This device then utilizes a reverse RF injection scheme wherein the electromagnetic wave to be amplified is applied at the large end of the tapered waveguide so that it propagates in the waveguide toward the small end until it is reflected at the point in the waveguide taper where the individual frequency of the wave approximately matches the cutoff frequency of the waveguide. The reflected wave then co-propagates with and is amplified by the electron beam.

The reflection-type gyrotron traveling-wave amplifier disclosed in the above-referenced Application employed an external circulator device coupled to the single port formed by the large end of the tapered waveguide to separate the input and output of the amplifier. The use of an external circulator is disadvantageous because presently available wideband high power circulators for use at millimeter wavelengths do not exhibit sufficiently low standing wave ratios (VSWR) so as to allow stable high gain amplification.

An alternative input/output coupling technique is disclosed in Application Ser. No. 06/389,132, filed June 12, 1982, entitled "Wide-Band Distributed rf Coupler" by, L. R. BARNETT, Y. Y. LAU, K. R. CHU and V. L. GRANATSTEIN. The gyrotron traveling-wave amplifier disclosed therein comprises a distributed input coupler involving multiple-cavity coupling between an input waveguide and a tapered interaction waveguide. The coupler includes a plurality of channel filters distributed along the length of the tapered waveguide, with each channel filter comprising several coupled cavities in tandem for suppressing spurious modes.

The distributed coupler provides wide bandwidth coupling and thus complements the inherent broadband characteristics of the gyrotron traveling-wave amplifier. The distributed coupler, however, is mechanically complex and thus is difficult to construct.

The present Invention provides a novel solution to the problem of coupling energy into and out of a traveling-wave amplifier.

SUMMARY OF THE INVENTION

Accordingly, one object of the present Invention is to provide a novel traveling-wave amplifier.

Another object is to provide a novel means for coupling electromagnetic energy into and out of a traveling-wave amplifier.

Still another object is to provide a novel, simple, and efficient means for coupling electromagnetic energy into and out of a traveling-wave amplifier.

Yet another object is to provide a novel traveling-wave amplifier including an integral active input/output circulator.

These and other objects and advantages are provided by a novel RF traveling-wave amplifier according to the present Invention which includes an interaction waveguide having first and second ends. The interaction waveguide is capable of supporting first and second orthogonal polarization modes therein with approximately the same propagation characteristics for each of the two modes. An electron beam generator device directs a relativistic beam of electrons with helical electron motion into the interaction waveguide through the first end to axially propagate toward the second end of the waveguide. A magnetic field generator device generates a magnetic field within the waveguide in a direction approximately parallel to the axis of the waveguide. The magnetic field is profiled to near grazing interaction with the second polarization mode of the waveguide. An input electromagnetic wave of the first polarization mode is launched into the interaction waveguide to co-propagate with the electron beam and is amplified thereby. The input wave excites the second polarization mode in the waveguide which additionally co-propagates with the electron beam and is amplified thereby. The second polarization mode is amplified to a greater extent than the first polarization mode.

In a preferred embodiment of the present Invention, the interaction waveguide takes the form of a tapered waveguide having a cross-section which gradually increases from a small first end to a larger second end thereof. The magnetic field is similarly tapered to correspond to the taper of the tapered interaction waveguide. The input wave is launched into the tapered waveguide at the larger second end to propagate toward the smaller first end thereof such that various frequency components of the input wave are reflected at various points along the constriction of the taper of the waveguide. The second polarization mode is excited by the reflected input wave in the tapered waveguide.

BRIEF DESCRIPTION OF THE DRAWINGS

A more complete appreciation of the present Invention and many of the attendant advantages thereof will be readily obtained as the same becomes better understood by reference to the following detailed description when considered in connection with the accompanying drawings, wherein.

FIG. 4 is a plot of the magnetic field as a function of axial position along the interaction waveguide of the gyrotron traveling-wave amplifier shown in FIG. 3;

FIG. 5 is a plot of the electron beam transverse velocity to axial velocity ratio $\alpha$ as a function of the kicker electrode potential for the electron gun of the gyrotron traveling-wave amplifier shown in FIG. 3; and FIG. 6 is a cross-sectional view of the interaction waveguide of the gyrotron traveling-wave amplifier shown in FIG. 3 taken in the plane V—V shown in FIG. 3.

DETAILED DESCRIPTION OF THE PREFERRED EMBODIMENTS

Figure 1:
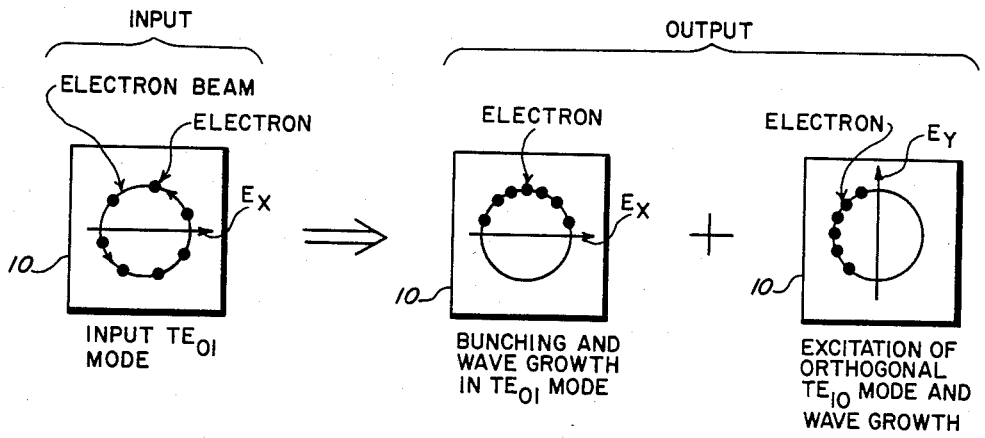
FIG. 1 is a schematic illustration of the principle of the present Invention.

The present Invention is directed to a tapered interaction waveguide incorporating an integral input/output circulator for use in traveling-wave electron amplification devices. The present Invention will be described in the context of a gyrotron amplifier, which is a fast wave device, although it should be understood that the Invention may also be utilized with many other types of beam-wave interaction devices such as klystrons, magnetrons, linear beam traveling-wave amplifiers, ubitrons, free-electron lasers, etc.

The basic reflecting-type gyrotron traveling-wave amplifier utilizing a tapered interaction waveguide is described in some detail in the above-mentioned Applications and by K. R. CHU, Y. Y. LAU, L. R. BARNETT, and V. L. GRANATSTEIN in an article entitled "Theory of a Wide-Band Distributed Gyrotron Traveling-Wave Amplifier", appearing in IEEE Transactions on Electron Devices, Vol. ED-28, No. 7, July 1981. Additional information on the reflecting-type amplifier is provided in Y. Y. LAU, L. R. BARNETT, and V. L. GRANATSTEIN, "Gyrotron Travelling Wave Amplifier: IV. Analysis of Launching Losses", International Journal of Infrared and Millimeter Waves, Vol. 3, No. 1, 1982, pages 45–62. These references are hereby incorporated by reference.

Amplification in the traveling-wave amplifier described in these references, as in other traveling-wave amplifiers, is based on the coherent stimulated emission of radiation from electrons in a traveling-wave structure. In the case of the gyrotron, the electron cyclotron maser mechanism is utilized to obtain relativisitic azimuthal phase bunching which is discussed at some length in the above-incorporated references. In the gyrotron, the phases of the electrons in their cyclotron orbits are initially random. However, relativistic azimuthal bunching occurs when the electrons, with their cyclotron motion, interact with RF radiation at appropriate frequencies. The resulting phase bunching from this rotating electron interaction with the RF wave causes the electrons to radiate coherently and thus to amplify the wave.

The basic interaction waveguide referred to in the above-incorporated references comprises a waveguide wall which is tapered from a small end to a larger end. The rationale behind this tapering of the waveguide is that there is a minimum frequency for which electromagnetic waves will propagate in a waveguide of constant cross-section. This minimum frequency or cutoff frequency will change as the cross-section of the waveguide changes. When electromagnetic waves propagate into a portion of the waveguide where those frequencies are less than the minimum frequency, then waves with these frequencies will be reflected such that they propagate axially in the waveguide toward the larger end thereof. By tapering the waveguide, ie., gradually changing the cross-section thereof, the minimum frequency or cutoff frequency for the waveguide will change. Thus, waves with different frequencies will be reflected from different points along the waveguide structure. Accordingly, an input wave composed of a plurality of frequencies will have its different frequencies reflected at different points along the tapered waveguide as those frequencies reach the various points in the waveguide where they are equal to the waveguide minimum or cutoff frequency. Accordingly, it can be seen that the use of a tapered interaction waveguide will significantly increase the bandwidth of the radiation that can propagate efficiently therein if the input wave is launched from the large end and is allowed to propagate toward the small end.

In the aforementioned Applications incorporated by reference, an electron gun is utilized to generate a beam of electrons to propagate in the tapered interaction waveguide such that the beam co-propagates with the RF radiation propagating therein. Accordingly, the electron beam is injected into the small end of the interaction waveguide such that it propagates in the axial direction therein with the wall radius of the waveguide increasing in the downstream direction of the beam. The tapered interaction waveguide, and/or the entire system including the electron gun may be disposed inside a magnetic circuit for generating a magnetic field within the tapered waveguide. When the magnetic field generated by the magnetic circuit is properly profiled relative to the waveguide, wide-band amplification of the RF radiation via coherent electron stimulated emissions will occur.

It can be seen from the above that the proper wide-band operation of the amplifier will depend, in large measure, on the efficient coupling of wide-band RF energy into the tapered interaction waveguide. The present Invention is directed to a novel coupling structure which is integrated into the tapered interaction waveguide.

Referring now to the drawings, wherein like reference numerals and characters designate like or corresponding parts throughout the several views, and more particularly to FIG. 1 thereof, a pictoral illustration of the principle of the present Invention is presented. The present Inventors have determined that when a square cross-section waveguide is used to form the tapered wall interaction waveguide in a reflecting-type gyrotron traveling-wave amplifier and when the input fundamental mode is horizontally polarized ($TE_{01}$), the amplifier output wave is approximately equal in the vertical and horizontal polarizations, $TE_{10}$, and $TE_{01}$, respectively. Thus, in FIG. 1, a beam of electrons following circular orbits is shown passing through a cross-section of a square tapered wall waveguide 10. On the left side of FIG. 1, randomly spaced electrons in their circular orbits are shown in the presence of a $TE_{01}$ mode input wave. The right side of FIG. 1 illustrates electron bunching and wave growth in the $TE_{01}$ and $TE_{10}$ modes.

The present Inventors have further determined that the square cross-section waveguide may be suitably modified according to the present Invention such that wave growth may be made to favor one orthogonal mode over the other. Thus, according to the present Invention the waveguide 10 is made slightly rectangular in cross-section and/or a thin layer of dielectric material is added to the waveguide inner surfaces to load one polarization mode relative to the other polarization mode such that the cutoff frequencies of both orthogonal modes are within a few percent of each other. By appropriately profiling the magnetic field of the amplifier to near grazing interaction with the higher frequency of cutoff mode, with a lower cutoff frequency input mode the gain of the amplifier is the largest for the output mode which has the higher cutoff frequency. Thus, for a $TE_{01}$ input mode the gain of the amplifier will be much greater for the $TE_{10}$ output mode than for the $TE_{01}$ output mode. This effect is more clearly illustrated in FIG. 2 wherein a dispersion diagram for the present Invention is illustrated. As illustrated, the beam cyclotron mode is synchronized with the $TE_{10}$ output mode and the cutoff frequency of the dielectrically loaded $TE_{01}$ input mode is several percent lower than that of the output mode.

Referring now to FIGS. 3 through 6, a gyrotron traveling-wave amplifier 20 according to a preferred embodiment of the present Invention is illustrated in detail. The amplifier device 20 includes an electron gun 22 for generating a hollow beam of electrons 24 which propagate in helical orbits in the axial direction (Z) in a rectangular tapered wall interaction waveguide 26. The cross-sectional area of the waveguide 26 increases in the downstream direction of the electron beam 24. The waveguide 26, or the entire amplifier 20 including the electron gun 22, is disposed within a magnetic circuit 28 which generates a magnetic field B within the waveguide 26. After passing through the waveguide 26, the electron beam 24 is dissipated in a collector structure 30 located downstream of the waveguide 26 and coupled to the large end 29 thereof. Downstream from the collector structure 30 is a vacuum window 32 followed by an input/output 0 dB coupler 34. In operation, the input/output coupler 34 directs electromagnetic energy to propagate upstream toward the narrow or tapered end 36 of the waveguide 26 at the same time that the electron beam 24 is injected at the narrow end 36 to propagate axially in the waveguide 26 in the opposite direction. The input wave is reflected at various points (where the individual frequencies in the wave match the cutoff frequency of the waveguide) along the taper of the waveguide 26 such that the reflected wave copropagates with the electron beam. When the magnetic field generated by the magnetic circuit 28 is properly profiled relative to the waveguide 26, wide-band amplification will be obtained.

The magnetic circuit 28 for generating the axial magnetic field B may assume a variety of configurations. Preferably the magnetic circuit comprises a main magnetic circuit formed by a super-conducting solenoid (not illustrated) operating in conjunction with a trim magnetic circuit (not illustrated) for appropriately tapering or profiling the magnetic field in the region of the waveguide 26. Such a magnetic circuit is described in detail in the above-mentioned Application Ser. No. 06/389,133, incorporated herein by reference. Other appropriate magnetic circuit configurations may be used, as should be apparent to those of skill in the art.

Figure 2:
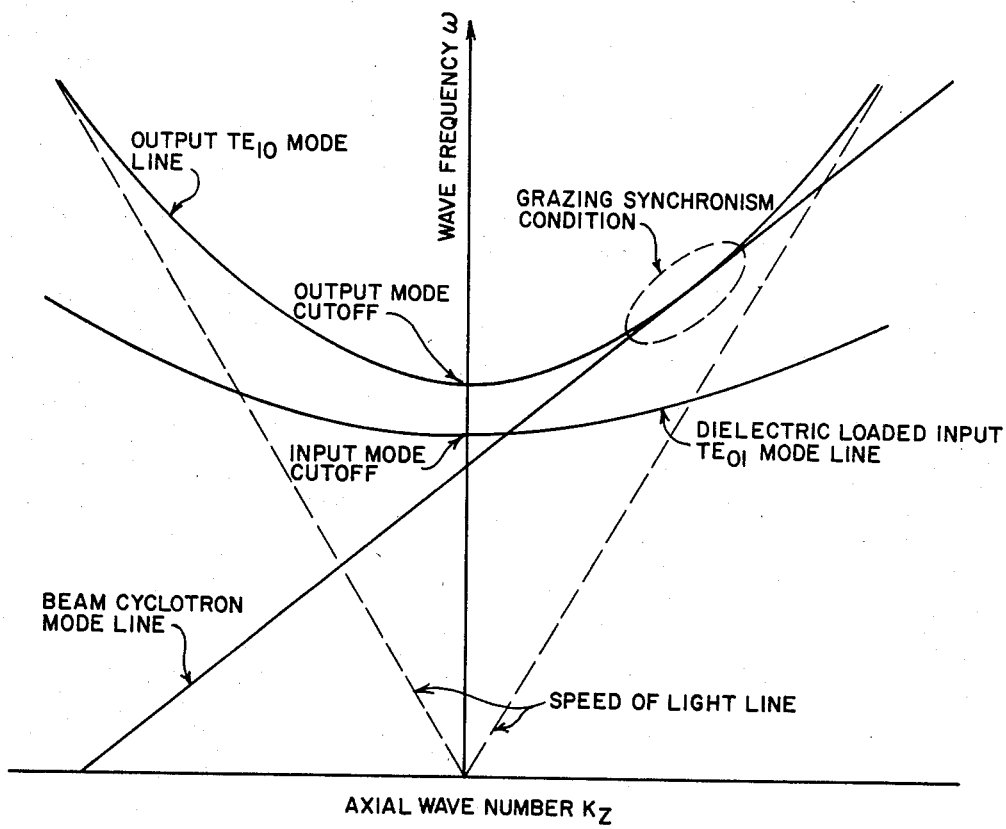
FIG. 2 is a dispersion diagram which illustrates the principle of the present Invention.

As previously mentioned, the axial magnetic field produced by the magnetic circuit 28 should be profiled to near grazing interaction with the higher frequency of cutoff mode along the entire length of the waveguide 26 as illustrated in FIG. 2. The equation for this magnetic field profile is as follows:

$$\frac{B}{B_o} = \frac{\gamma_{Zo}^2 \beta_{\perp o}^2 \lambda_{\omega o}^2}{2\lambda_\omega^2}\left[1 + \left(1 + \frac{4\lambda_\omega^2}{\gamma^2 \gamma_{Zo}^2 \beta_{\perp o}^4 \lambda_{\omega o}^2}\right)^{\frac{1}{2}}\right] \quad (1)$$

where:

$B_o$ is the magnetic field at the narrow end 36 of the waveguide 26;

$\gamma = (1 - V_\perp^2/C^2 - V_z^2/C^2)^{-\frac{1}{2}}$ $\gamma_{zo} = (1 - V_{\perp o}^2/C^2 - V_{zo}^2/C^2)^{-\frac{1}{2}}$ $\beta_{\perp o}$ = electron velocity perpendicular to the magnetic field at the narrow end or electron entrance of the waveguide divided by C;

$\lambda_w$ is the cutoff wavelength of the output $TE_{10}$ mode of the tapered waveguide;

$\lambda_{wo}$ is the cutoff wavelength of the output $TE_{10}$ mode of the tapered waveguide at the narrow end thereof;

$V_\perp$ is the electron velocity perpendicular to the waveguide axis;

$V_z$ is the electron velocity parallel to the waveguide axis;

$V_{zo}$ is the electron velocity parallel to the waveguide axis at the narrow end of the waveguide;

$V_{\perp o}$ is the electron velocity perpendicular to the waveguide axis at the narrow end of the waveguide; and C is the free space speed of light.

FIG. 4 illustrates the magnetic field profile produced by the magnetic circuit 28 as a function of the axial position (Z axis) along the waveguide 26. The magnetic field varies essentially linearly from approximately 15 kG at the narrow end 36 (Z=0) of the waveguide 26 to approximately 9 kG at the large end 29 (Z=33 cm) of the waveguide 26. A small magnetic field 50 of approximately 1.2 kG occurs at the output of the electron gun 22 and the field decreases rather rapidly to zero at the other end of the amplifier in the vicinity of the electron collector structure 30.

Although not illustrated, it should be understood that a Dewar structure surrounds the magnetic circuit 28 to maintain proper temperature and pressure for the superconducting portions thereof. The Dewar structure generally will be made of a non-magnetic material, such as stainless steel, which is suitable for the configuration described herein and filled with an appropriate cooling media, such as liquid helium.

The electron gun 22 comprises a semi-spherical shaped cathode 60 and an anode 62 positioned within a shield 64 to form a conventional space change limited Pierce electron gun producing a 40 kV, 1.0 amp electron beam 24. Transverse energy is imparted to the electron beam by means of an electrostatic kicker comprising first and second parallel cylindrical electrodes 70 and 72, respectively, disposed on either side of the beam at the output of the gun. The first electrode 70 is biased to a positive potential +V while the second electrode is biased to a negative potential −V such that a potential of several kilovolts appears across the electrodes.

The electrostatic kicker operates in conjuction with the 1.2 kG magnetic field (region 50 in FIG. 4) provided by the magnetic circuit 28 at the output of the electron gun 22 to produce the hollow electron beam 24 of electrons traveling in helical orbits. The velocity spread in the electron beam is on the order of 9 percent which is adequate to provide sufficient gain and efficiency in the amplifier. Lower velocity spreads can be achieved by increasing the magnetic field in the vicinity of the electron gun by means of magnetic trim coils (not illustrated) or other appropriate means.

Figure 3:
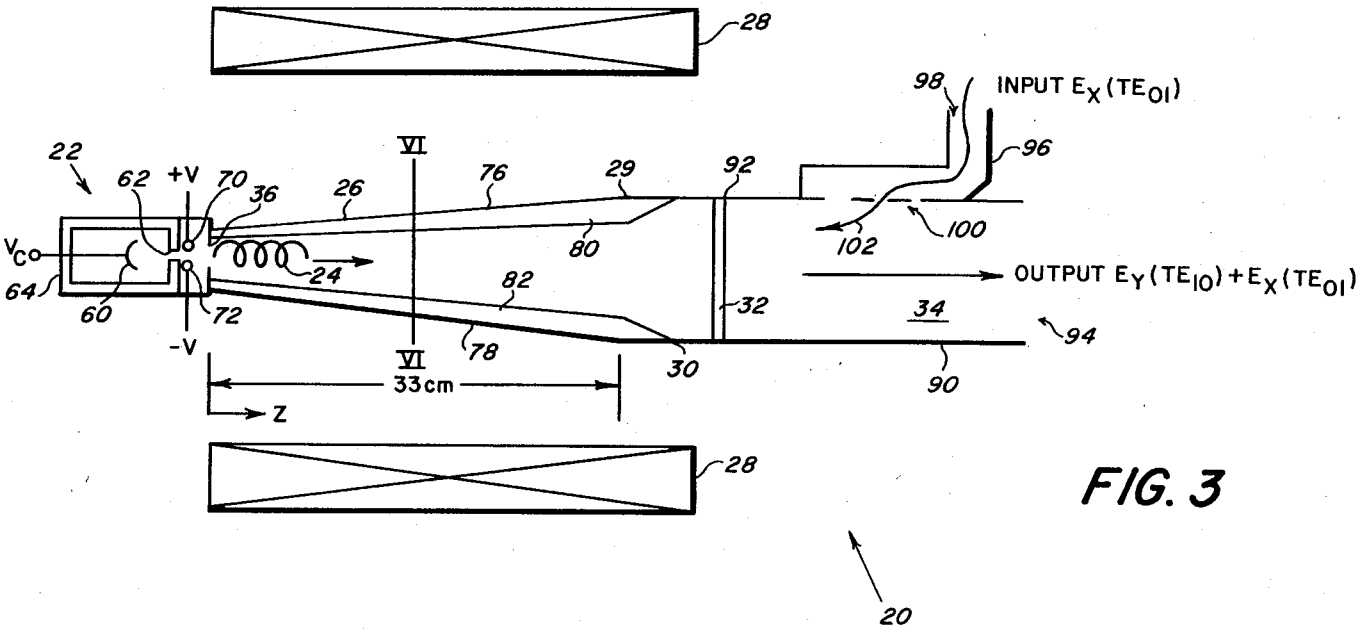
FIG. 3 is a schematic illustration of a gyrotron traveling-wave amplifier according to a preferred embodiment of the present Invention.

The ratio $\alpha$, equal to the ratio of the transverse electron velocity $V_\perp$ to the axial velocity $V_z$ of the electron beam, may easily be varied in the electron gun 22 by changing the total electrode potential $|+V|+|-V|$, as illustrated in FIG. 5 for two values of beam voltage, 30 kV and 40 kV. In the embodiment of FIG. 3 an $\alpha$ value of 1.0 or higher is preferably used.

Numerous alternative electron gun designs may be used with the present Invention. For example, a magnetron electron gun is commonly used in gyro-type devices. The combination Pierce gun and electrostatic kicker, described above, is preferably used because it produces a very small diameter beam, on the order of 0.75 mm, and thus is compatable with the diameter of the narrow end 36 of the waveguide 26 used in the present Invention.

As previously described, the interaction waveguide 26 is a tapered wall waveguide having a rectangular cross-section. FIG. 6 illustrates a cross-section of the waveguide 26 taken at the mid-point of the waveguide in a plane V—V perpendicular to the longitudinal axis of the amplifier as indicated in FIG. 3. As shown in FIG. 6, the waveguide 26 has a height "h" and a width "w". The waveguide is very slightly rectangular such that the cutoff frequencies for the $TE_{01}$ and $TE_{10}$ modes differ by typically two percent. The result of using the slightly rectangular waveguide is that the two fundamental orthogonal modes ($TE_{10}$ and $TE_{01}$) in the amplifier will amplify by different amounts.

This effect can be enhanced by coating the upper and lower surfaces, 76 and 78 respectively, which span the width of the waveguide 26 with respective thin layers 80 and 82 of dielectric material having a thickness "t" at the midpoint cross-section as shown in FIGS. 3 and 6. The dielectric layers 80 and 82 should be appropriately tapered to match the taper of the waveguide 26 as shown in FIG. 3. The thin dielectric layers 80 and 82 act to load the horizontal polarization mode $TE_{01}$ and thus to weaken the interaction between the $TE_{01}$ input mode and the beam at large values of the axial wave number $K_Z$ as shown in FIG. 2. The cutoff frequencies are still maintained to within a few percent of each other. Various dielectric materials having various permitivities may be used to form the dielectric layers 80 and 82. Materials having permitivities ($\epsilon_r$) in the range of 4 to 10 may typically be used. Also, the dielectric material need not be restricted to flat layers on the waveguide walls as shown in FIGS. 3 and 6. Thus, the dielectric material may be applied in many ways to load one of the orthogonal modes relative to the other, such as by covering only portions of the walls with the dielectric material, or by using suitably positioned dielectric rods, ect., as should be apparent to persons of skill in the art.

It should be understood that the interaction waveguide 26 is of the tapered wall type. The taper of the waveguide 26 described herein is linear; however, the present Invention is not limited to such a linear taper. The tapered wall characteristics of the waveguide 26 and their relationship to the magnetic field profile are discussed in the abovereferenced Applications, incorporated herein by reference.

The input/output coupler 34 acts to provide input and output ports for the amplifier 20. The coupler includes a coupler waveguide 90 joined at one end 92 to the electron beam collector 30 and separated therefrom by the window 32. The opposite end of the coupler waveguide 90 forms the output port 94 of the amplifier and may be coupled to a load (not illustrated) by well-known transmission waveguides (not illustrated). As will be discussed further below, signals having components in two orthogonal modes will appear as outputs of the amplifier at the output port 94. These two modes may be separated external to the amplifier by well-known standard techniques.

An input waveguide 96 is joined to one wall of the coupler waveguide 90. The input waveguide provides an input port 98 for receiving input electromagnetic waves. These input waves are directed into the coupler waveguide 90 and thence into the interaction waveguide 26 through a suitable array of coupling apertures 100, located in the wall of the coupler waveguide at the intersection of the input waveguide 96, which serve to directionally couple between the input waveguide 96 and the coupler waveguide 90. The coupler 34 is designed to couple 100 percent (0 dB coupling) of the input signal to the $TE_{01}$ mode in the coupler waveguide 90 and to couple it in the direction of the amplifier as shown by the arrow 102. Additionally, the coupler is designed such that energy exiting the amplifier in the $TE_{10}$ mode is not coupled into the input waveguide 96. Such couples can take various forms and are well-known in the art.

In operation, a horizontally polarized ($E_X$) $TE_{01}$ signal is directed into the amplifier 20 through the input waveguide 96 and the coupler waveguide 90. The input signal is directed from the coupler waveguide 90 into the interaction waveguide 26 through the large end 29 thereof where it travels upstream toward the narrow end 36 in the direction opposite to that traveled by the electron beam 24. The input signal travels up the tapered interaction waveguide 26 until it reaches a region along the waveguide where the waveguide walls have tapered to below cutoff for the frequency of the input signal. The horizontally polarized $TE_{01}$ input wave is reflected by the construction of the waveguide 26 at this cutoff region to travel downstream and to co-propagate with the electron beam 24 in the waveguide 26. The co-propagating reflected input signal absorbs energy from the electron beam 24 and, simultaneously, a vertically polarized ($E_Y$) $TE_{10}$ mode is excited which also co-propagates with the electron beam and is amplified thereby. Due to the slightly rectangular cross-section of the waveguide 26 and the presence of the dielectric layers 80 and 82 and the grazing interaction synchronism with the vertical $TE_{10}$ mode, the reflected horizontal $TE_{01}$ mode is amplified to a lesser amount than that of the vertical $TE_{10}$ mode. The output signal of the waveguide 26 thus comprises components in both the $TE_{10}$ and $TE_{01}$ modes, with the $TE_{10}$ mode predominating. The output signal travels out of the waveguide 26 through the large end 29 and into the coupler waveguide 90 of the coupler 34 where it exits the amplifier 20 through the output port 94. As previously mentioned, the $TE_{10}$ and $TE_{01}$ modes of the output signal may be separated by well-known techniques.

A proposed design for a tapered wall reflection type traveling-wave amplifier according to the present Invention, as shown in FIGS. 3 through 6 and as described herein above, will now be described for operation at 35 GHz. In this design, the interaction waveguide 26 is 33 cm long and is gradually linearly tapered at a slope of 0.0041 keeping all cross-section dimensions at a constant ratio. The magnetic field is correspondingly tapered, as given by Equation (1), to maintain synchronism and a near grazing interaction with the $TE_{10}$ output mode. The height h at the midpoint (16.5 cm) of the waveguide 26 is 4.04 mm. Similarly, the midpoint width w of the waveguide is 3.60 mm. The height to width wavelength cutoff ratio is 1.02 (due to the presence of the dielectric material). The upper and lower surfaces 76 and 78 of the waveguide are coated with a dielectric material having a relative permittivity $\epsilon_r$ of 4 and a thickness of 0.58 mm. The electron beam 24 is 1 ampere at 40 kV with an axial to perpendicular velocity ratio of 1.0. The calculated gain from a horizontally polarized $TE_{01}$ input mode to a $TE_{10}$ vertically polarized output mode is 35 db. The calculated gain from the horizontally polarized $TE_{01}$ input mode to a horizontally polarized $TE_{01}$ output mode is 13 db. Thus, since the $TE_{10}$ output mode is 22 db greater than the $TE_{01}$ output mode, greater than 99 percent of the output power will be in the $TE_{10}$ output mode for a $TE_{01}$ input. By using the input/output coupler 34 to excite the $TE_{01}$ input, the output $TE_{10}$ signal can pass out of the amplifier with no atenuation from the coupler. The calculated gain for a $TE_{10}$ input mode, as might occur due to reflection from the load, to the $TE_{10}$ output is 24 dB. Therefore, an additional 11 dB of stability gain margin is attained, hence, allowing stable reflecting amplifier gains of 35 dB for a reflection coefficient from the load of up to −24 dB. This is based on the assumption that no additional loss is added in the circuitry. The gain margin will improve even more with additional loss. The calculated gain for a $TE_{10}$ input to a $TE_{01}$ output is only 6 dB. Since the input/output coupler 34 will absorb this $TE_{01}$ signal no difficulties are presented.

The active circulator of the present Invention has been described with respect to a tapered wall reflection type gyrotron traveling-wave amplifier. However, it should be understood that circulator action will occur when the present Invention is used in conjunction with uniform waveguide gyrotron traveling-wave amplifiers and may provide benefits such as increased stability to these devices.

Additionally, although the present Invention has been described using a fundamental mode rectangular interaction waveguide, the present Invention is equally applicable to other modes and other types of waveguides. The requirements are that the waveguide system be capable of supporting two orthogonal modes with nearly the same propagation characteristics and having a similar bunching effect on the electrons. Obviously, the two fundamental modes of a slightly rectangular waveguide meet all these requirements. However, other orthogonal modes in rectangular waveguides may be used. Similarly, various orthogonal modes in waveguides of circular, elliptical, ridge, etc. cross-section and in combination waveguides such as circular waveguides with ridges, etc. may be used. Also, the present Invention is not restricted to gyrotron amplifiers and, thus, should apply equally as well to many other forms of beam-wave interaction devices such as klystrons, magnetrons, linear beam traveling-wave amplifiers, ubitrons, free-electron lasers, etc.

Additional descriptive information regarding the present Invention can be found in L. R. BARNETT et al., "A Wideband Fundamental Mode Millimeter Gyrotron TWA Experiment", International Electron Devices Meeting (IEDM 82), Technical Digest, Dec. 13, 1982, pages 375–378. This article is incorporated herein by reference.

Obviously, numerous (additional) modifications and variations of the present Invention are possible in light of the above teachings. It is therefore to be understood that within the scope of the appended claims, the present Invention may be practiced otherwise than as specifically described herein.

What is claimed as new and desired to be secured by Letters Patent of the United States is:

1. An RF traveling-wave amplifier comprising:

a tapered interaction waveguide wherein the cross-section thereof gradually increases from a small first end to a larger second end for propagating electromagnetic energy in a broad frequency band therein, said interaction waveguide supporting first and second orthogonal polarization modes therein with approximately the same propagation characteristic for said first and second modes;

means for generating a beam of relativistic electrons with helical electron motion and for directing said beam into said interaction waveguide through said small first end to axially propagate toward said larger second end of said interaction waveguide;

means for generating a tapered magnetic field within said interaction waveguide in a direction approximately parallel to the axis of said interaction waveguide and for profiling said magnetic field to near grazing interaction with said second polarization mode of said waveguide;

means disposed in said interaction waveguide for loading said first polarization mode relative to said second polarization mode;

means for launching an input electromagnetic wave of said first polarization mode into said interaction waveguide at said larger second end to propagate toward said smaller first end such that various different frequency components of said input wave will be reflected at various points along the constriction of said tapered interaction waveguide, said reflected input wave exciting said second polarization mode in said interaction waveguide such that said first and second polarization modes copropagate with said electron beam and are amplified thereby, the portion of said reflected wave in said second polarization mode being amplified to a greater extent than the portion of said reflected wave in said first polarization mode.

2. The RF traveling-wave amplifier as recited in claim 1, wherein said interaction waveguide comprises a nearly square rectangular cross-section.

3. The RF traveling-wave amplifier as recited in claim 2, wherein said nearly square rectangular cross-section yields cutoff frequencies for said first and second polarization modes differing by approximately 2 percent.

4. The RF traveling-wave amplifier as recited in claim 2, wherein said means disposed in said interaction waveguide for loading said first polarization mode relative to said second polarization mode is a coating of dielectric material on at least a portion of the inner surface of said interaction waveguide.

5. The RF traveling-wave amplifier as recited in claim 2 wherein said interaction waveguide comprises first and second inner surfaces spaning the width of said interaction waveguide and said means disposed in said interaction waveguide for loading said first polarization mode relative to said second polarization mode comprises:

a first dielectric layer coating said first inner surface of said interaction waveguide; and a second dielectric layer coating said second inner surface of said waveguide.

6. The RF traveling-wave amplifier as recited in claim 1, wherein:

said tapered interaction waveguide has a linear taper.

7. The RF traveling-wave amplifier as recited in claim 1, wherein:

said first polarization mode is the $TE_{01}$ mode; and said second polarization mode is the $TE_{10}$ mode.

8. The RF traveling-wave amplifier as recited in claim 1, wherein:

said tapered interaction waveguide is selected from the group of waveguide types consisting of: circular cross-section, rectangular cross-section, elliptical cross-section, ridge waveguide, circular cross-section with ridges.

9. The RF traveling-wave amplifier as recited in claim 1, which further comprises:

an output waveguide coupled to said larger second end of said interaction waveguide to couple output electromagnetic energy from said interaction waveguide;

said means for launching said input wave comprising an input waveguide coupled to an array of apertures in one side wall of said output waveguide, said input waveguide coupling said input wave into said interaction waveguide through said output waveguide.

10. The RF traveling-wave amplifier as recited in claim 1, wherein:

said magnetic field generated by said magnetic field generating means is profiled closely in accordance with the equation:

$$\frac{B}{B_o} = \frac{\gamma_{Zo}\beta_{\perp o}^2\lambda_{\omega o}^2}{2\lambda_\omega^2}\left[1+\left(1+\frac{4\lambda_\omega^2}{\gamma^2\gamma_{Zo}^2\beta_{\perp o}^4\lambda_{\omega o}^2}\right)^{\frac{1}{2}}\right]$$

where:

$B_o$ is the axial magnetic field at the small first end of said interaction waveguide;

$\gamma=(1-V_\perp^2/C^2-V_z^2/C^2)^{-\frac{1}{2}}$ $\gamma_{zo}=(1-V_{\perp o}^2/C^2-V_{zo}^2/C^2)^{-\frac{1}{2}}$ $\beta_{\perp o}$=is the electron velocity perpendicular to the magnetic field at the small first end of the interaction waveguide divided by C;

$\lambda_w$ is the cutoff wavelength of said second polarization mode of said tapered interaction waveguide;

$\lambda_{wo}$ is the cutoff wavelength of said second polarization mode of said tapered interaction waveguide at the small first end thereof;

$V_\perp$ is the electron velocity perpendicular to the interaction waveguide axis;

$V_{\perp o}$ is the electron velocity perpendicular to the interaction waveguide axis at the small first end of said interaction waveguide;

$V_z$ is the electron velocity parallel to the interaction waveguide axis;

$V_{zo}$ is the electron velocity parallel to the interaction waveguide axis at the small first end of said interaction waveguide; and C is the free space speed of light.

11. An RF traveling-wave amplifier comprising:

an interaction waveguide having first and second ends, said interaction waveguide supporting first and second orthogonal polarization modes therein with approximately the same propagation characteristics for said first and second modes;

means for generating a beam of relativistic electrons with helical electron motion and for directing said beam into said interaction waveguide through said first end to axially propagate toward said second end of said interaction waveguide;

means for generating a magnetic field within said interaction waveguide in a direction approximately parallel to the axis of said interaction waveguide and for profiling said magnetic field to near grazing interaction waveguide means disposed in said interaction waveguide for loading said first polarization mode relative to said second polarization mode;

means for launching an input electromagnetic wave of said first polarization mode into said interaction waveguide to co-propagate with said electron beam and be amplified thereby said input wave exciting said second polarization mode which additionally co-propagates with said electron beam and is amplified thereby, said second polarization mode being amplified to a greater extent than said first polarization mode.

12. The RF traveling-wave amplifier as recited in claim 11, wherein said interaction waveguide comprises:

a tapered interaction waveguide having a small first end and a larger second end, the cross-section of said interaction waveguide gradually increasing from the small first end to the larger second end thereof;

said magnetic field generated by said magnetic field generating means being tapered to correspond to the taper of said interaction waveguide;

said input wave being launched into said interaction waveguide at said larger second end thereof to propagate toward said smaller first end such that various frequency components in said input wave will be reflected at various points along the constriction of the taper of said waveguide, said reflected input wave exciting said second polarization mode in said interaction waveguide.

13. The RF traveling-wave amplifier as recited in claim 12, wherein said interaction waveguide comprises a nearly square rectangular cross-section.

14. The RF traveling-wave amplifier as recited in claim 13, wherein said nearly square rectangular cross-section yields cutoff frequencies for said first and second polarization modes differing by approximately 2 percent.

15. The RF traveling-wave amplifier as recited in claim 13 wherein the means disposed in said interaction waveguide for loading said first polarization mode relative to said second polarization mode is a coating of dielectric material on at least a portion of the inner surface of said interaction waveguide.

16. The RF traveling-wave amplifier as in claim 13, wherein said interaction waveguide comprises first and second inner surfaces spanning the width of said interaction waveguide and said means disposed in said interaction waveguide for loading said first polarization mode relative to said second polarization mode comprises;

a first dielectric layer coating said first inner surface of said waveguide; and a second dielectric layer coating said second inner surface of said waveguide.

17. The RF traveling-wave amplifier as recited in claim 12, wherein:

said tapered interaction waveguide has a linear taper.

18. The RF traveling-wave amplifier as recited in claim 12, wherein:

said first polarization mode is the $TE_{01}$ mode; and said second polarization mode is the $TE_{10}$ mode.

19. The RF traveling-wave amplifier as recited in claim 12, wherein:

said tapered interaction waveguide is selected from the group of waveguide types consisting of: circular cross-section, rectangular cross-section, elliptical cross-section, ridge waveguide, circular cross-section with ridges.

20. The RF traveling-wave amplifier as recited in claim 12, which further comprises:

an output waveguide coupled to said larger second end of said interaction waveguide to couple output electromagnetic energy from said interaction waveguide;

said means for launching said input wave comprising an input waveguide coupled to an array of apertures in one side wall of said output waveguide, and input waveguide coupling said input wave into said interaction waveguide through said output waveguide.

21. The RF traveling-wave amplifier as recited in claim 12, wherein:

said magnetic field generated by said magnetic field generating means is profiled closely in accordance with the equation:

$$\frac{B}{B_o} = \frac{\gamma_{Zo}\beta_{\perp o}^2\lambda_{\omega o}^2}{2\lambda_\omega^2}\left[1+\left(1+\frac{4\lambda_\omega^2}{\gamma^2\gamma_{Zo}^2\beta_{\perp o}^4\lambda_{\omega o}^2}\right)^{\frac{1}{2}}\right]$$

wherein:

$B_o$ is the axial magnetic field at the small first end of said interaction waveguide;

$\gamma=(1-V_\perp^2/C^2-V_z^2/C^2)^{-\frac{1}{2}}$ $\gamma_{zo}=(1-V_{\perp o}^z/C^2-V_{zo}^2/C^2)^{-\frac{1}{2}}$ $\beta_{\perp o}$ is the electron velocity perpendicular to the magnetic field at the small first end of the interaction waveguide divided by C;

$\lambda_w$ is the cutoff wavelength of said second polarization mode of said tapered interaction waveguide;

$\lambda_{wo}$ is the cutoff wavelength of said second polarization mode of said tapered interaction waveguide at the small first end thereof;

$V_\perp$ is the electron velocity perpendicular to the interaction waveguide axis;

$V_{\perp o}$ is the electron velocity perpendicular to the interaction waveguide axis at the small first end of said interaction waveguide;

$V_z$ is the electron velocity parallel to the interaction waveguide axis;

$V_{zo}$ is the electron velocity parallel to the interaction waveguide axis at the small first end of the interaction waveguide; and C is the free space speed of light.

* * * * *